US010993602B1

(12) United States Patent
Sims

(10) Patent No.: US 10,993,602 B1
(45) Date of Patent: May 4, 2021

(54) ADJUSTABLE DISHWASHER RACK

(71) Applicant: Jonathan Sims, Doraville, GA (US)

(72) Inventor: Jonathan Sims, Doraville, GA (US)

( * ) Notice: Subject to any disclaimer, the term of this patent is extended or adjusted under 35 U.S.C. 154(b) by 0 days.

(21) Appl. No.: 16/857,179

(22) Filed: Apr. 24, 2020

(51) Int. Cl.
*A47L 15/50* (2006.01)

(52) U.S. Cl.
CPC ..... *A47L 15/505* (2013.01); *A47L 15/501* (2013.01)

(58) Field of Classification Search
CPC ..... A47L 15/50; A47L 15/501; A47L 15/503; A47L 15/504; A47L 15/505; A47L 15/507; A47L 19/04; A47B 81/04
See application file for complete search history.

(56) References Cited

U.S. PATENT DOCUMENTS 132,998 A * 11/1872 Yaw ..... A47B 81/00 312/290
1,573,466 A * 2/1926 Ward ..... A47B 71/00 312/299
3,160,448 A * 12/1964 Abernathy ..... A47B 88/483 384/23
3,266,632 A * 8/1966 Maslow ..... A47L 15/501 211/41.8
3,339,994 A * 9/1967 Reddig ..... F25D 25/021 312/301
3,367,529 A * 2/1968 Welch ..... A47L 15/501 220/572
3,515,450 A * 6/1970 Jaecke ..... A47B 67/02 312/245
3,889,837 A * 6/1975 Wilson ..... B65D 11/1833 220/7
4,113,329 A * 9/1978 Thurman ..... B65D 11/14 206/509
4,346,807 A * 8/1982 Weihe ..... A47L 15/50 211/70.7
4,577,773 A * 3/1986 Bitel ..... A47B 88/994 220/533
5,184,749 A * 2/1993 Attenasio ..... A47L 13/51 15/257.01
5,268,149 A * 12/1993 Arafat ..... B01L 9/00 206/560

(Continued)

FOREIGN PATENT DOCUMENTS

DE 10144959 C1 * 1/2003 ..... A47L 19/04
EP 2486843 A2 * 8/2012 ..... A47L 15/502

*Primary Examiner* — Stanton L Krycinski
(74) *Attorney, Agent, or Firm* — Johan Eide; Christopher Pilling

(57) ABSTRACT

The present invention relates to an adjustable dishwashing rack having a base member further having a base plate and at least two vertical walls, at least one lid and at least one removable end wall. At least one removable end wall is adjoined to at least two vertical walls of the base member forming an internal volume. A series of connection assemblies serve to adjoin at least one lid, at least one removable end wall and the base member in different configurations determined by the user of the adjustable dishwashing rack. When washing articles of different sizes, at least one lid may be variably inserted parallel to the base plate of the base member allowing for the user to select and control an internal volume of the adjustable dishwashing rack to match the size of at least one article to be washed within the adjustable dishwashing rack.

16 Claims, 14 Drawing Sheets

(56) References Cited

U.S. PATENT DOCUMENTS 5,350,304 A * 9/1994 Fula ..... A63H 33/12 312/213
5,967,356 A * 10/1999 Laarhoven ..... B65D 11/1833 220/6
6,179,134 B1 * 1/2001 Pine ..... A47L 19/04 211/41.3
6,401,950 B1 * 6/2002 Chiang ..... B62B 3/005 220/1.5
6,786,339 B2 * 9/2004 Deiss ..... A47L 15/505 211/41.8
6,824,232 B2 * 11/2004 Farmer ..... A47B 88/00 312/293.2
7,137,397 B2 * 11/2006 Rosenbauer ..... A47L 15/502 134/56 D
7,159,730 B2 * 1/2007 Rumpel ..... B65D 11/1833 220/23.6
7,815,265 B2 * 10/2010 Lee ..... A47L 15/507 312/228.1
8,287,224 B2 * 10/2012 Carpinelli ..... A47L 15/501 414/405
8,602,240 B1 * 12/2013 Laurita ..... B65D 11/18 220/4.28
9,955,850 B2 * 5/2018 Isbilen ..... A47L 15/50
10,709,295 B2 * 7/2020 Bauer ..... A47B 73/008
2007/0062888 A1 * 3/2007 Russell ..... A47L 15/0065 211/41.9
2008/0121253 A1 * 5/2008 Shotwell ..... A47L 15/505 134/25.4
2009/0050587 A1 * 2/2009 Sandor ..... A47L 15/501 211/74
2011/0108682 A1 * 5/2011 Boaz ..... A47B 81/00 248/99
2017/0303685 A1 * 10/2017 Rehage ..... A47B 88/43
2018/0338666 A1 * 11/2018 Seewang ..... A47L 15/4285

* cited by examiner

ADJUSTABLE DISHWASHER RACK

BACKGROUND

1. Field of the Invention

The present invention relates to an adjustable dishwasher rack for adapting to and securing kitchen utensils.

2. Description of Related Art

Traditionally silverware, utensils, cups, plates, and other common kitchen items are accumulated in a commercial and residential kitchen workspace to be washed. These items are therein commonly loaded into a dishwasher rack or tray that conveniently adapts to fit inside many commercial dishwashers. Dividers, tabs, and shaped inserts are known in residential and commercial dishwashing racks and trays. Commonly, these racks and trays are arranged and designed for the vertical insertion and placement of kitchen utensils into open-top cavities within the rack, trays, or in separate mesh plastic bins within. For example, common silverware is loaded within plastic bins having a perforated mesh pattern. The plastic bins aide the user in retaining the silverware or other articles from dispersing and moving around inside of the dishwasher during washing.

As water is moved within the dishwasher and mechanical components rotate within many commercial dishwashers, water is thrust about within the dishwasher causing articles within the dishwasher to be turned over, moved, or damaged. This is detrimental in articles having a cupped form or any internal cavities, as water and biological residue is accumulated within the article turned upside down. Problems arise when articles requiring a specific orientation or direction of insertion are thrown onto a dishwasher rack or tray. A solution is needed for securing kitchen utensils and articles of different sizes within the same kitchen rack or tray.

Another common problem occurring in commercial and residential kitchens is accumulation of biological matter within crevasses, cracks, cavities, slots and many more locations of dishwashing racks and trays. Traditionally, dishwashing racks are minimalistic in design and are often universal between different dishwashing machine manufacturers. In some commercially available dishwasher racks inserts, dividers, baskets, and other articles are loosely inserted into the racks or trays and not secured to the frame of the rack or tray. As inserts, dividers, baskets, and other articles are incorporated into dishing racks with the kitchen utensils and articles, often even further cleaning is necessary to remove accumulated biomass from the inserts, dividers and baskets. This extra cleaning time only increases further when the dividers, baskets and inserts have a plurality of crevasses, cracks, cavities, and slots. A solution is needed for smooth, easy-to-clean, secure and reliable connection points for accessories adjoined to dish racks and trays.

SUMMARY

The present invention provides an adjustable dish washing rack to solve the problems presented above and for adapting to secure kitchen utensils of variable sizes or shapes. When washing articles of different sizes, at least one lid may be variably inserted parallel to the base plate of the base member allowing for the user to select and control an internal volume of the adjustable dishwashing rack to match the size of at least one article to be washed within the adjustable dishwashing rack.

Another object of the present invention is to provide an adjustable means for securing at least one article of different sizes. For example, the user may desire to wash a small sized cup or a large sized cup, either cup being secured by moving at least one lid along different incremental levels of a first connection assembly.

Another object of this invention is to lock the orientation of at least one article being washed within the adjustable dishwashing rack. For example, a cup can be locked in an upside down position with the open cavity of the cup pointing down, therein allowing water and biological matter to efficiently exist and enter the cup without being retained within the cup after a washing cycle of a washing machine is complete.

In order to do so, an adjustable dishwashing rack is provided, comprising a base member having a base plate and at least two vertical walls, at least one lid and at least one removable end wall. At least one removable end wall is adjoined to the at least two vertical walls of the base member forming an internal volume. A series of connection assemblies serve to adjoin at least one lid, at least one removable end wall, and the base member in different configurations determined by the user of the adjustable dishwashing rack.

BRIEF DESCRIPTION OF THE FIGURES

The detailed description of some embodiments of the invention is made below with reference to the accompanying figures, wherein like numerals represent corresponding parts of the figures.

The novel features of the disclosure are set forth with particularity in the appended claims. A better understanding of the features and advantages of the present disclosure will be obtained by reference to the following detailed description that sets forth illustrative embodiments, in which the principles of the disclosure are utilized, and the accompanying drawings of which:

DETAILED DESCRIPTION OF CERTAIN EMBODIMENTS

While preferred embodiments of the present disclosure have been shown and described herein, it will be obvious to those skilled in the art that such embodiments are provided by way of example only. Numerous variations, changes, and substitutions will now occur to those skilled in the art without departing from the disclosure. It should be understood that various alternatives to the embodiments of the disclosure described herein may be employed in practicing the disclosure.

Figure 1:
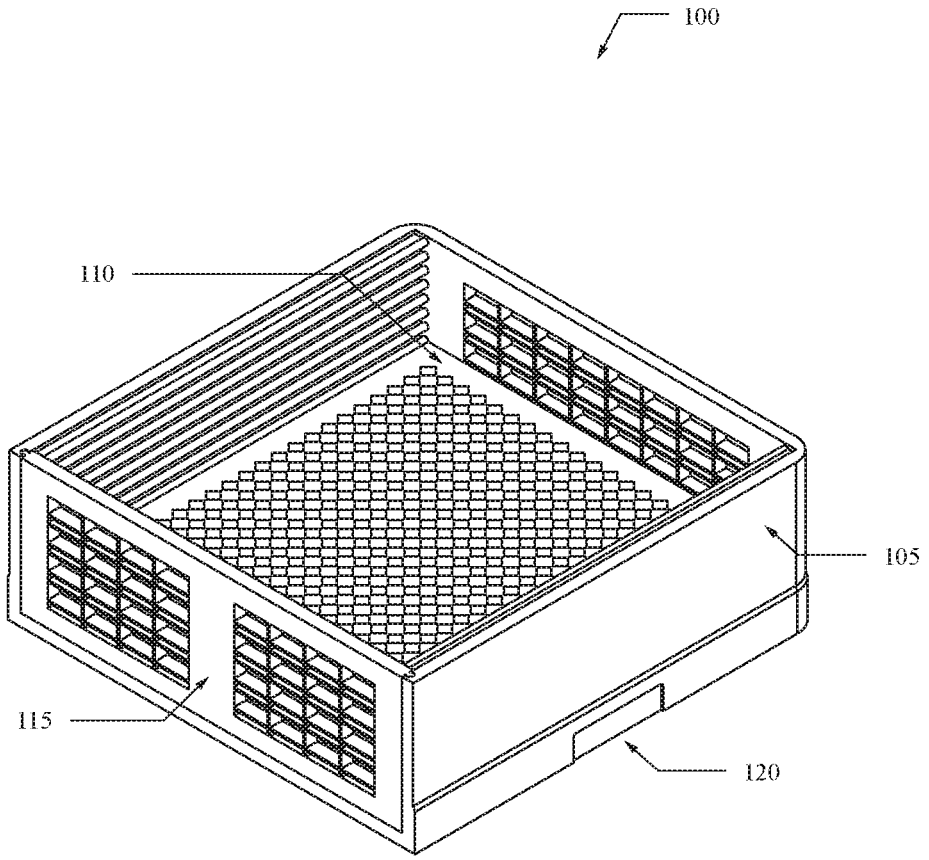
FIG. 1 shows an exemplary perspective view of one embodiment of the adjustable dishwasher rack.
Figure 2:
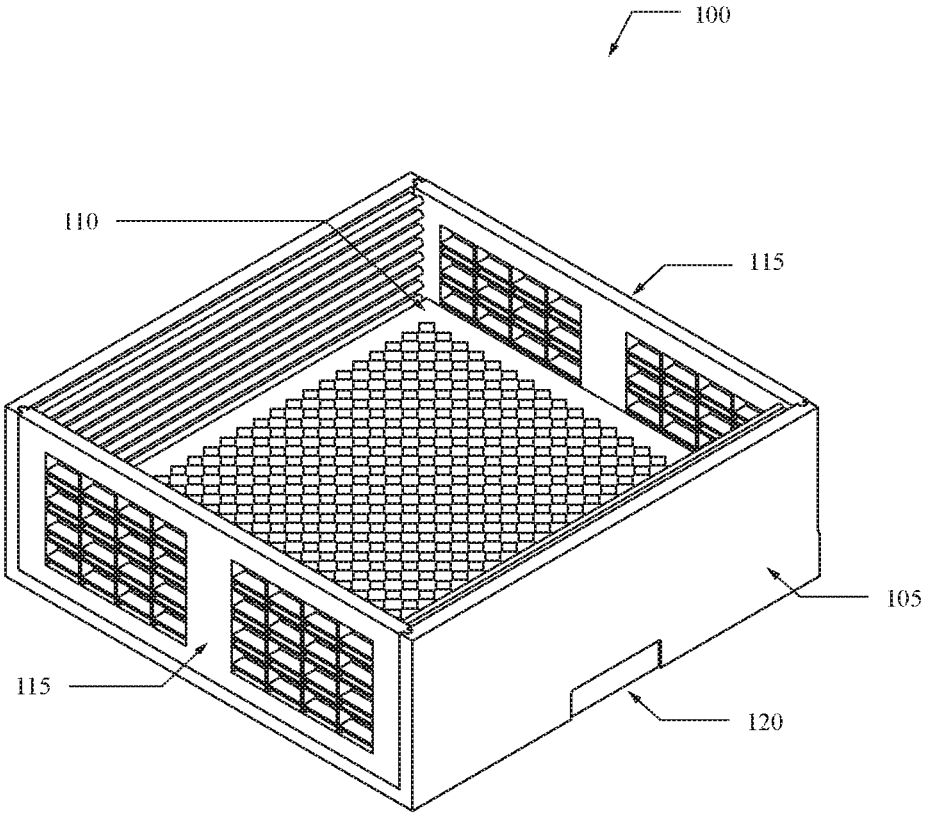
FIG. 2 shows an exemplary perspective view of one embodiment of the adjustable dishwasher rack.
Figure 3:
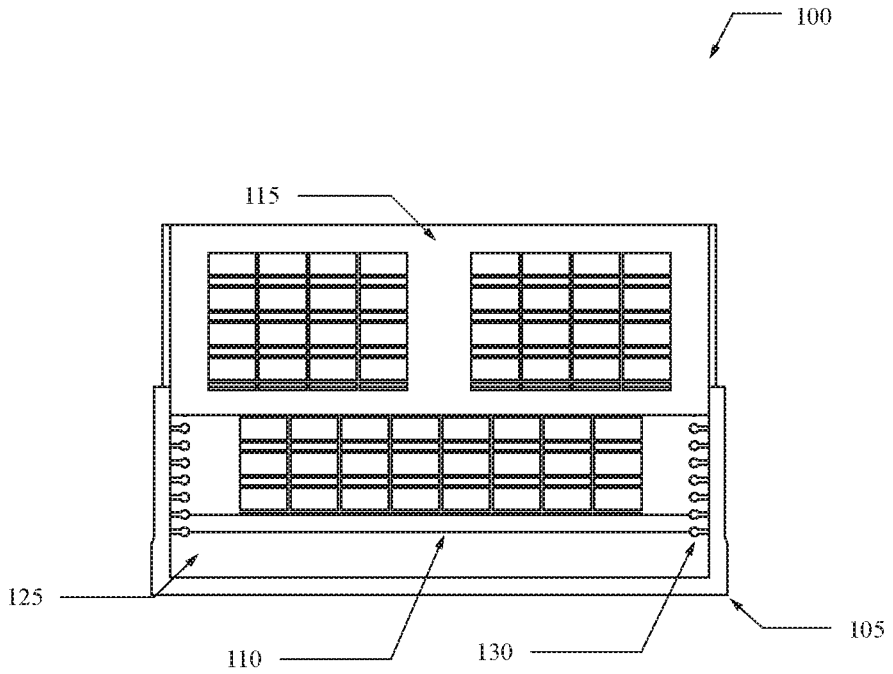
FIG. 3 shows an exemplary front view of one embodiment of the adjustable dishwasher rack.

FIG. 1 and FIG. 2 illustrate exemplary embodiments of an adjustable dishwashing rack 100 for securing at least one article (not shown) while washing the at least one article during the dishwashing process. The adjustable dishing rack comprises a base member 105 having a base plate 106 and at least two vertical walls extending away from the base plate. Next, at least one lid 110 is optionally installed within the base member having a top surface, a bottom surface, and a first perimeter edge. In some embodiments, the adjustable dishwashing rack does not have at least one lid. The adjustable dishwashing rack having at least one removable end wall 115, wherein each removable end wall includes an internal surface, an external surface, and a second perimeter edge. In some embodiments, the adjustable dishwashing rack does not have at least one removable end wall. At least one removable end wall is adjoined to the vertical walls of the base member forming an internal volume 125 within the adjustable dishwashing rack. At least one article to be washed within the adjustable dishwashing rack is retained within the internal volume, thereby securing at least one article and limiting the movement and rotation of at least one article as forces from turbulent water within a dishwasher exit and enter the adjustable dishwashing rack. In turn, limiting the movement and rotation of at least one article allows water and biological matter to properly wash to properly exit at least one article.

On the vertical walls of the base member of the adjustable dishwashing rack, a first connection assembly 130 is shown extending a length of the base member and joined to at least two vertical walls, wherein the first connection assembly is oriented parallel with the base plate. A third connection assembly 175 joined to the first perimeter edge of at least one lid and configured to join to the first connection assembly. The third connection assembly serves as means to secure at least one lid to the base member and control the size if the internal volume. In some embodiments, the first connection assembly is configured to receive the third connection assembly. In some embodiments, the third connection assembly is configured to receive the first connection assembly.

Next, in some embodiments, the vertical walls of the base member of the adjustable dishwashing rack a second connection assembly 150 extending a length of the vertical walls of the base member. The second connection assembly oriented perpendicular to the base plate. A fourth connection assembly 170 is joined to the second perimeter edge of at least one removable end wall. The fourth connection assembly serves as means to secure at least one removable end wall to the base member. In some embodiments, the second connection assembly is configured to receive the fourth connection assembly. In some embodiments, the fourth connection assembly is configured to receive the second connection assembly.

Figure 6:
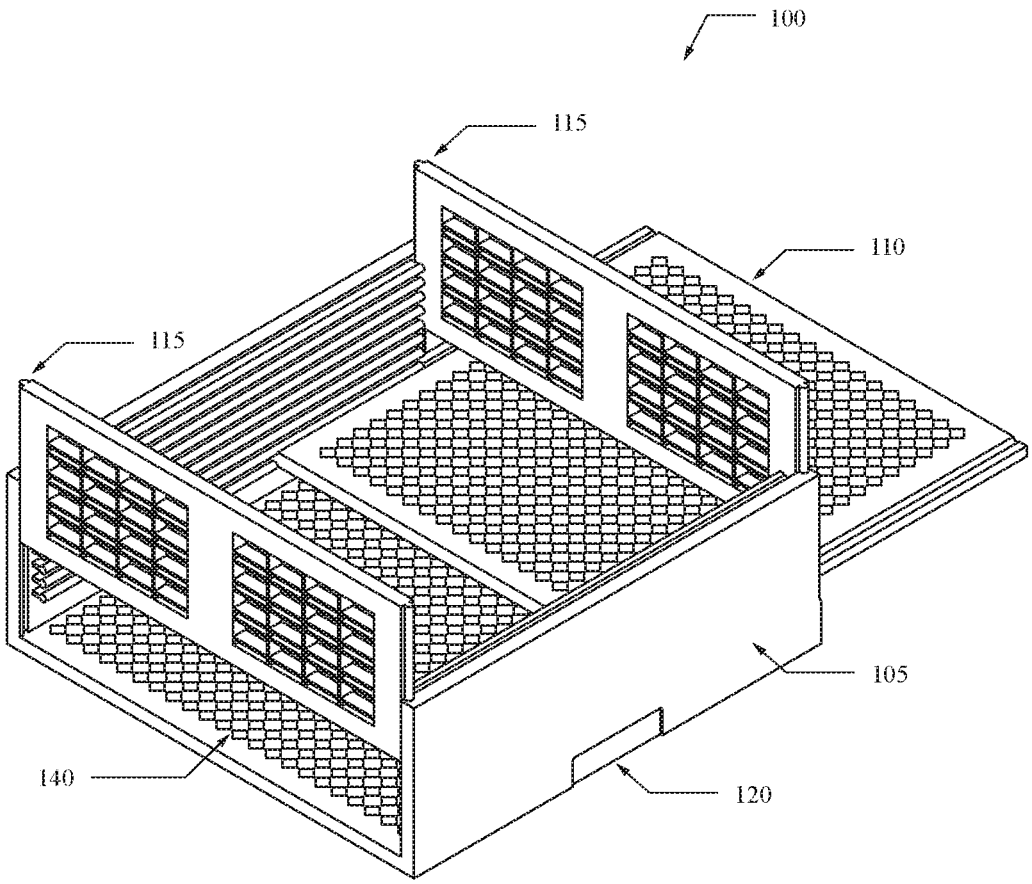
FIG. 6 shows an exemplary perspective view of one embodiment of the adjustable dishwasher rack.
Figure 7A:
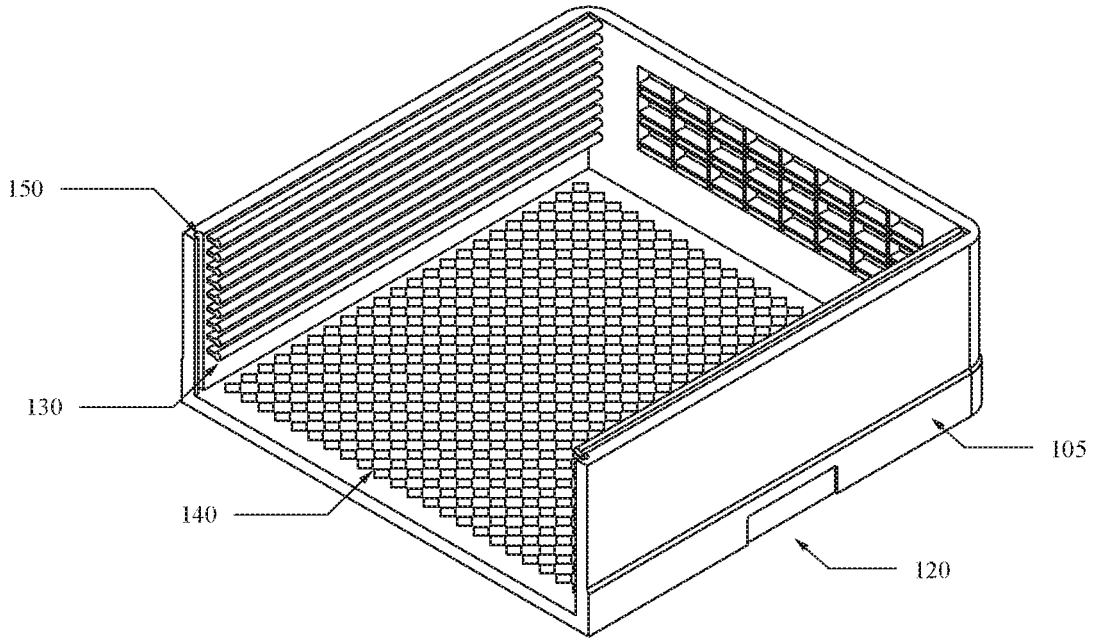
FIGS. 7A and 7B shows an exemplary perspective view of one embodiment of the base member of the adjustable dishwasher rack.
Figure 7B:
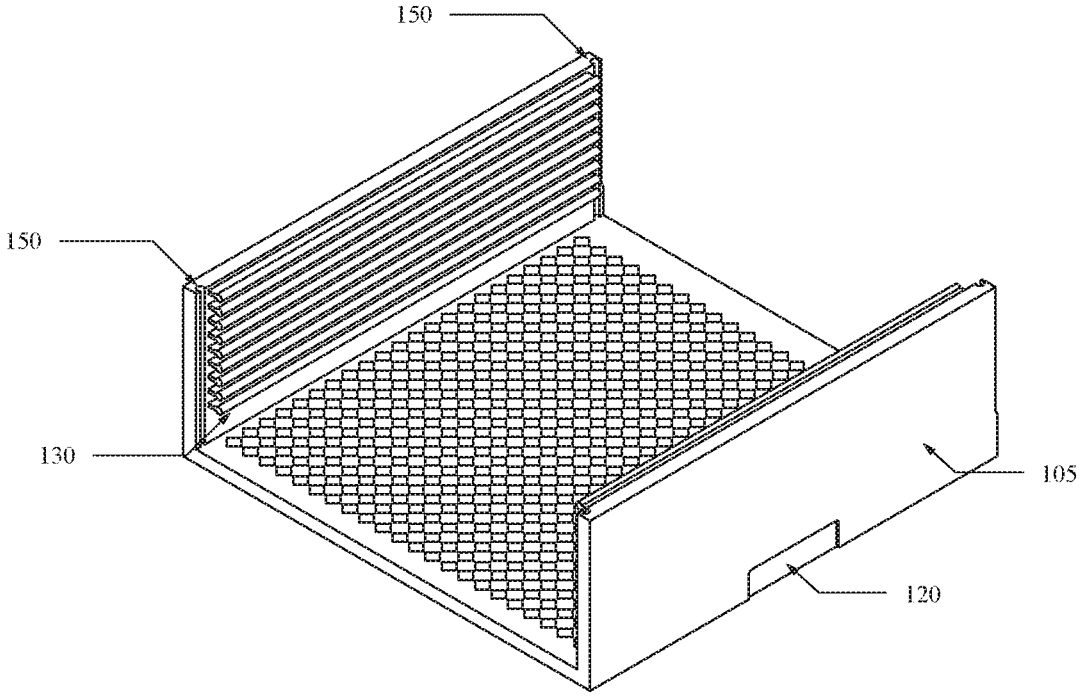

In an embodiment having more than one removable end wall, each of the removable end walls include a separate unit of the fourth connection assembly, the base member of the adjustable dishwashing rack further comprises at least two second connection assemblies adjoined to the vertical walls of the base member, and at least two second connection assemblies adapted to receive each of the removable end walls on opposite sides of the base member, as shown in FIG. 6.

Figure 4:
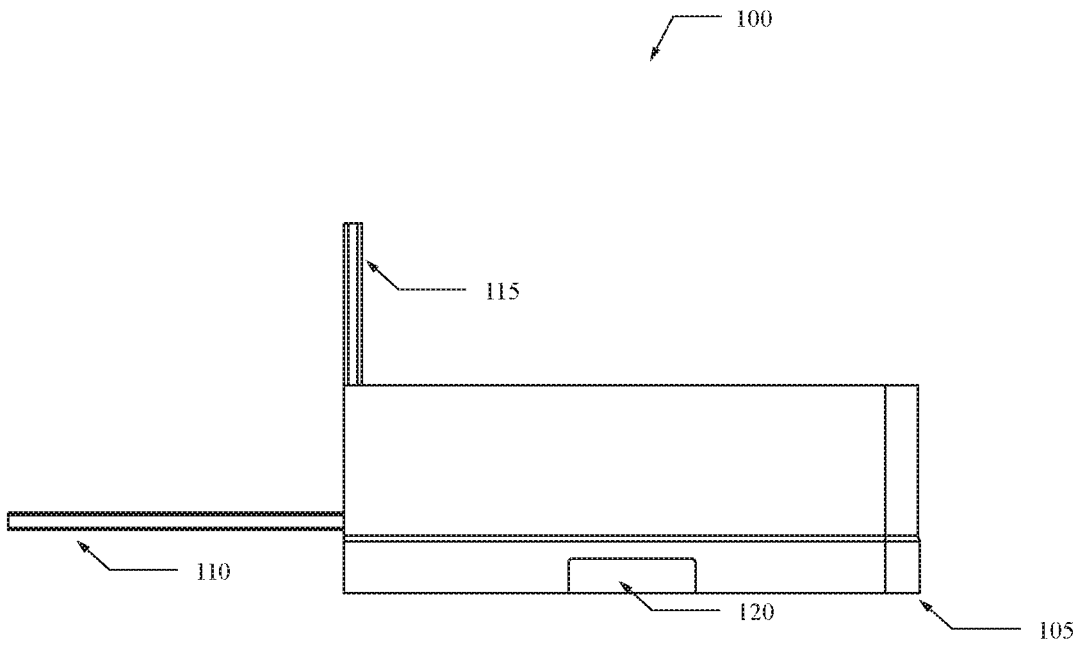
FIG. 4 shows an exemplary right view of one embodiment of the adjustable dishwasher rack.
Figure 5:
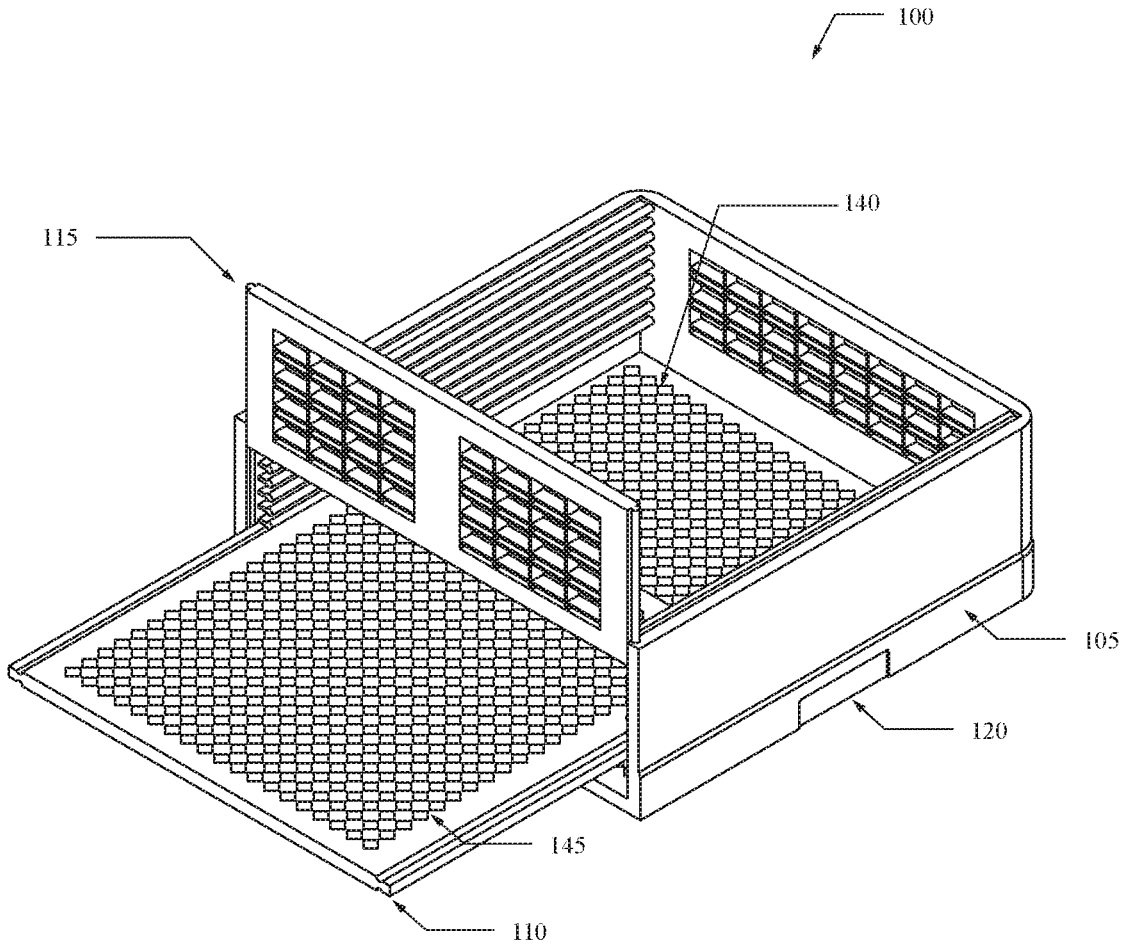
FIG. 5 shows an exemplary perspective view of one embodiment of the adjustable dishwasher rack.

FIGS. 3-6 illustrate the adjustable dishwashing rack at different positions of assembly. FIG. 4 illustrates the adjustable dishwashing rack from a right view, wherein the lid is partially removed from the base member and the removable end wall is extended vertically above the base member. The adjustable dishwashing rack is configured to allow the user to determine the size of the internal volume needed to match a size of the articles to be washed within the adjustable dishwashing assembly. In some embodiments, at least one removable end wall retains the lid within the adjustable dishwashing rack by blocking the linear movement of the lid parallel to the first connection assembly.

Embodiments of the removable end wall and the lid are shown in FIGS. 10A-10B and FIGS. 11A-11B. Drainage and sanitation is of the utmost importance in commercial dishwashing and the adjustable dishwashing rack is configured to maximize the drainage of water and biological matter out of the adjustable dishwashing rack. In some embodiments, edges of the adjustable dishwashing rack may be radiused. In order the facilitate drainage of water and biological matter out of the adjustable dishwashing rack and flow of water or a cleaning detergent into the adjustable dishwashing rack, the base member may further comprise at least one first perforated opening 140 extending through the base member. In some embodiments, the adjustable dishwashing rack further comprises at least one second perforated opening 145 extending through at least one lid. In some embodiments, the adjustable dishwashing rack further comprises at least one third perforated opening 142 extending through at least one removable end wall. In some embodiments, the first perforated opening, the second perforated opening, and the third perforated opening can have a cross-sectional shape comprising, by way of non-limiting example, a honeycomb shape, a square, a triangle, a rectangle, an octagon and an oval. In some embodiments, the base member is further configured to match an internal shape of commercially available dishwasher. For example, multiple units of the adjustable dishwashing rack may be inserted into different shelves of a commercially available dishwasher.

In exemplary industrial and residential dishwashing environments, the user can commonly lose grip of a kitchen utensil or at least one article to be washed due to accumulated water, soap, or biological matter. In some embodiments, aiding the user in holding onto the adjustable dishwashing rack is required. In some embodiments, the base member further comprises at least one handle slot protruding into the base member and configured to grip a hand of a human. In some embodiments, the base member further comprises an external texture to grip a hand of a human. The external texture further comprising at least one member of a texture set consisting of: indentations, extrusions, knurling, a rough surface, and bumps.

Figure 8A:
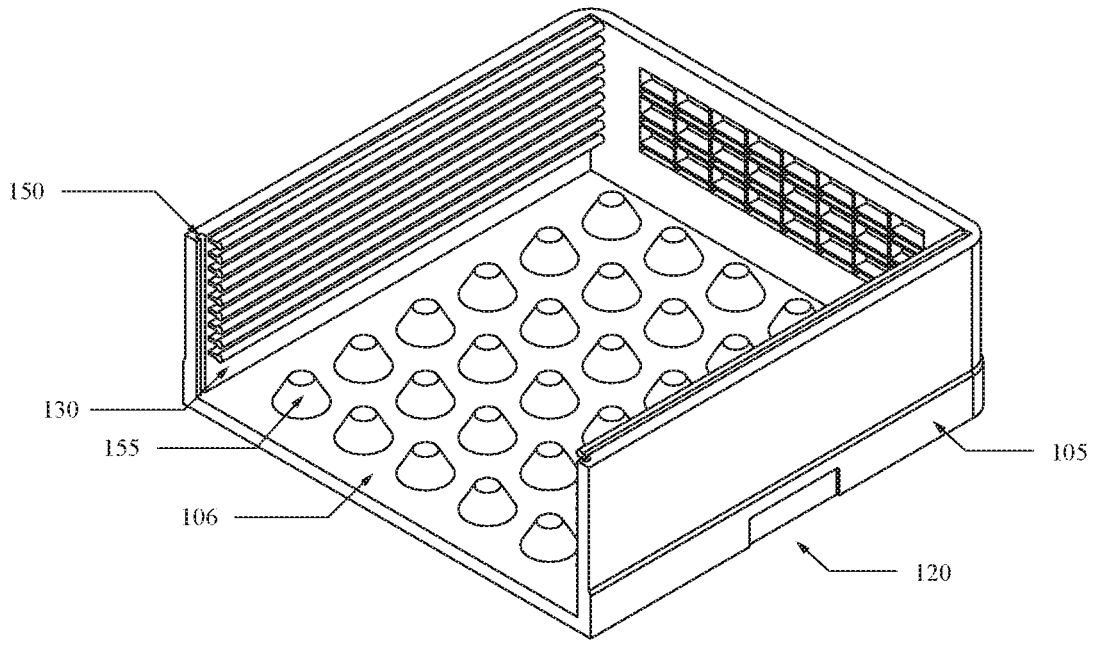
FIGS. 8A and 8B shows an exemplary perspective view of one embodiment of the base member of the adjustable dishwasher rack.
Figure 8B:
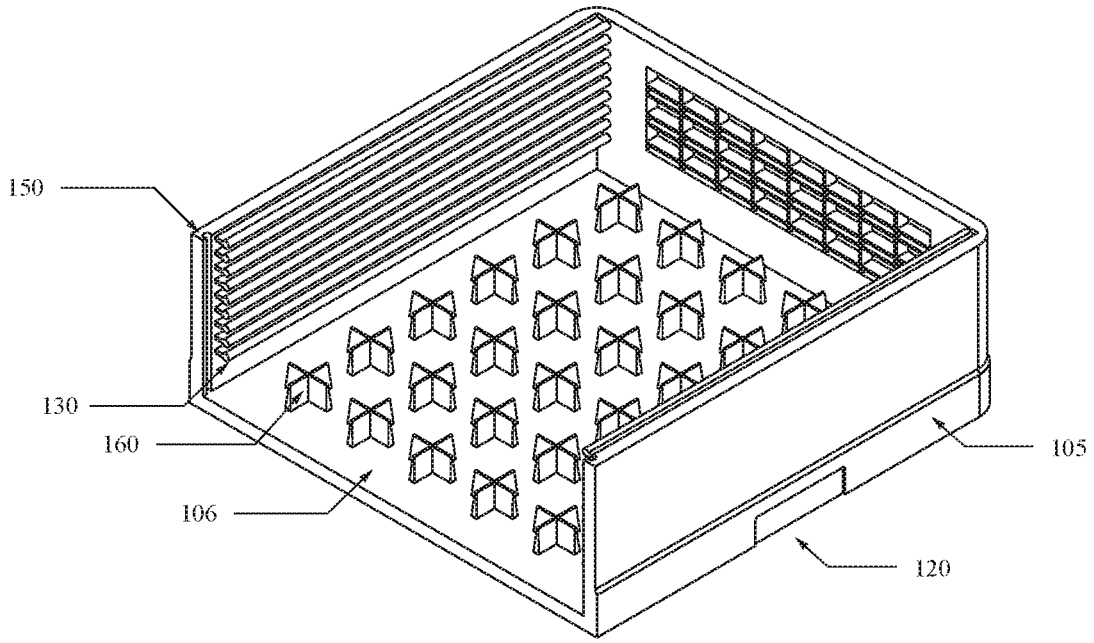
Figure 9A:
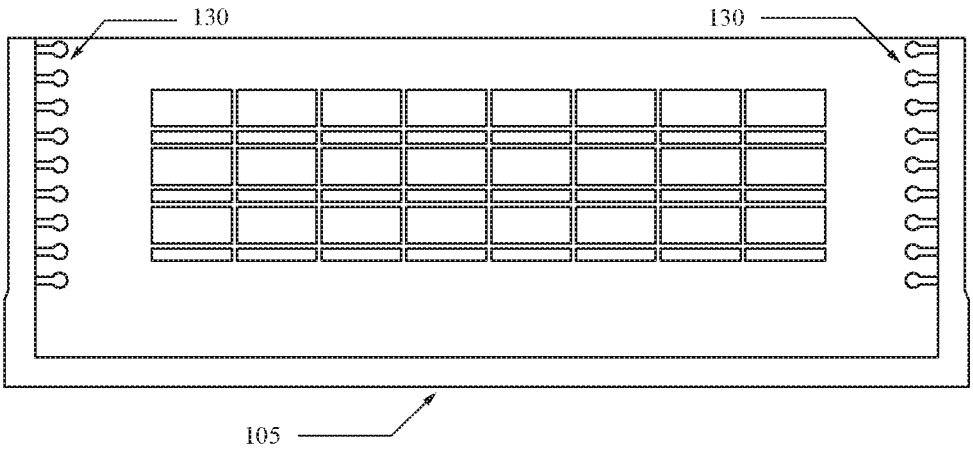
FIG. 9A shows an exemplary front view of one embodiment of the base member of the adjustable dishwasher rack.
Figure 9B:
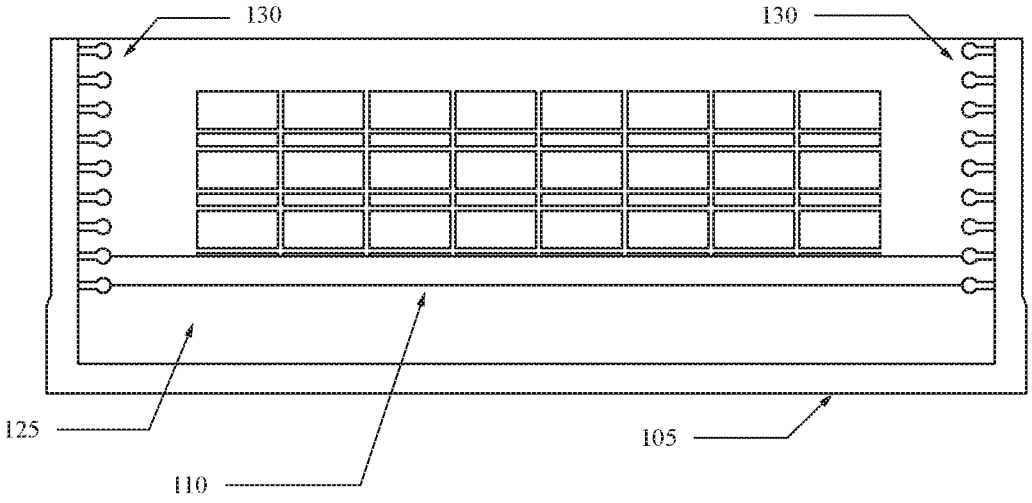
FIG. 9B shows an exemplary front view of one embodiment of the base member of the adjustable dishwasher rack having the lid shown mounted within the base member.
Figure 10A:
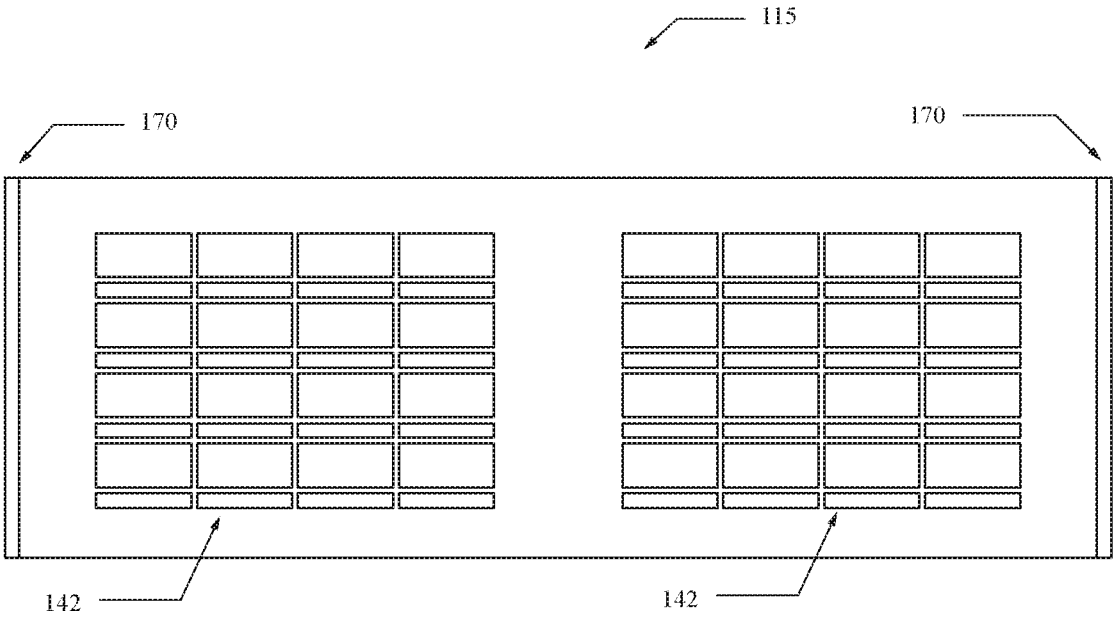
FIG. 10A shows an exemplary front view of one embodiment of the end wall of the adjustable dishwasher rack.
Figure 10B:
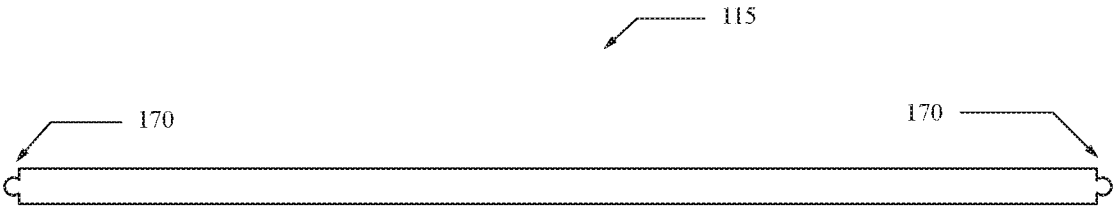
FIG. 10B shows an exemplary top view of one embodiment of the end wall of the adjustable dishwasher rack.

As shown in FIGS. 8A-8B, in some embodiments, the base plate of the base member further comprises a plurality of conical protrusions 155 extending into the internal volume. The plurality of conical protrusions assists in limiting movement of at least one cup. In some embodiments, the base plate of the base member further comprises a plurality of protrusions 160 extending into the internal volume. The plurality of protrusions assists in limiting movement of the articles. In some embodiments, the plurality of protrusions and the plurality of conical protrusions are formed to match the shape of at least one article being washed within the adjustable dishwashing rack.

Figure 11A:
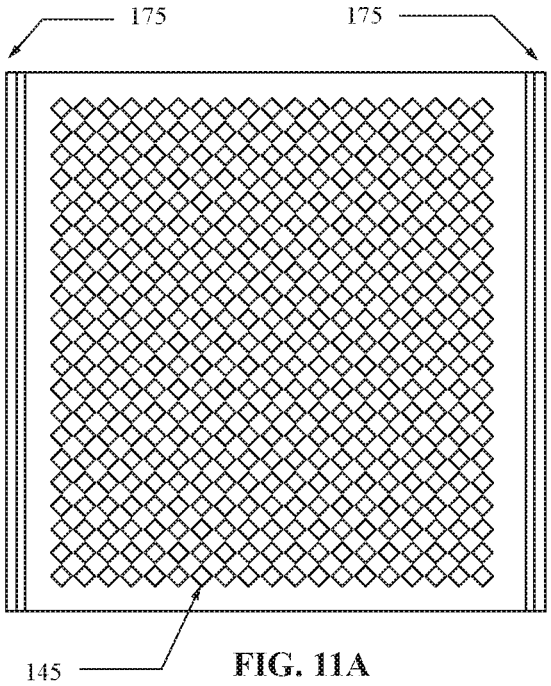
FIG. 11A shows an exemplary front view of one embodiment of the lid of the adjustable dishwasher rack.
Figure 11B:
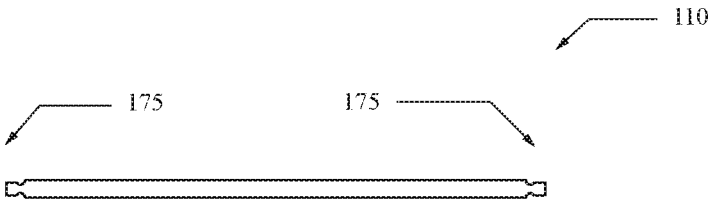
FIG. 11B shows an exemplary top view of one embodiment of the lid of the adjustable dishwasher rack.
Figure 12A:
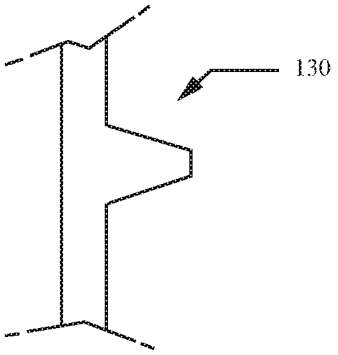
FIG. 12A-F shows an exemplary front views of one embodiment of the first attachment assembly of the adjustable dishwasher rack.
Figure 12B:
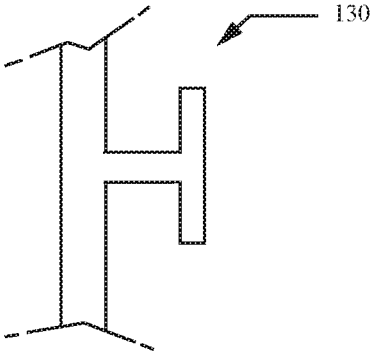
Figure 12C:
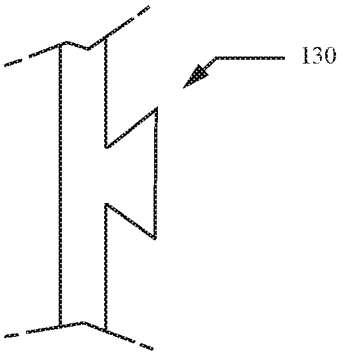
Figure 12D:
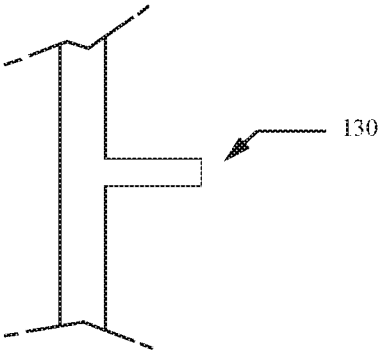
Figure 12E:
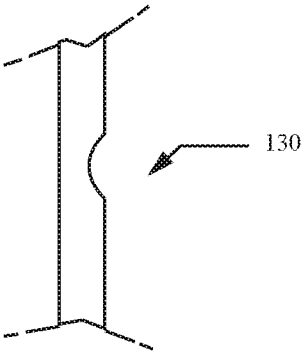
Figure 12F:
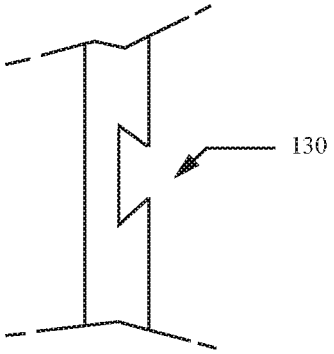

In FIGS. 11A-11B the lid of the adjustable dishwashing rack is shown in an embodiment having a plurality of the second perforated opening. In other embodiments, at least one lid further comprises a second plurality of protrusions (not shown) extending from the top surface or the bottom surface of the lid and perpendicular from the base plate. The second plurality of protrusions assist in limiting movement of the articles to be washed.

Figure 13:
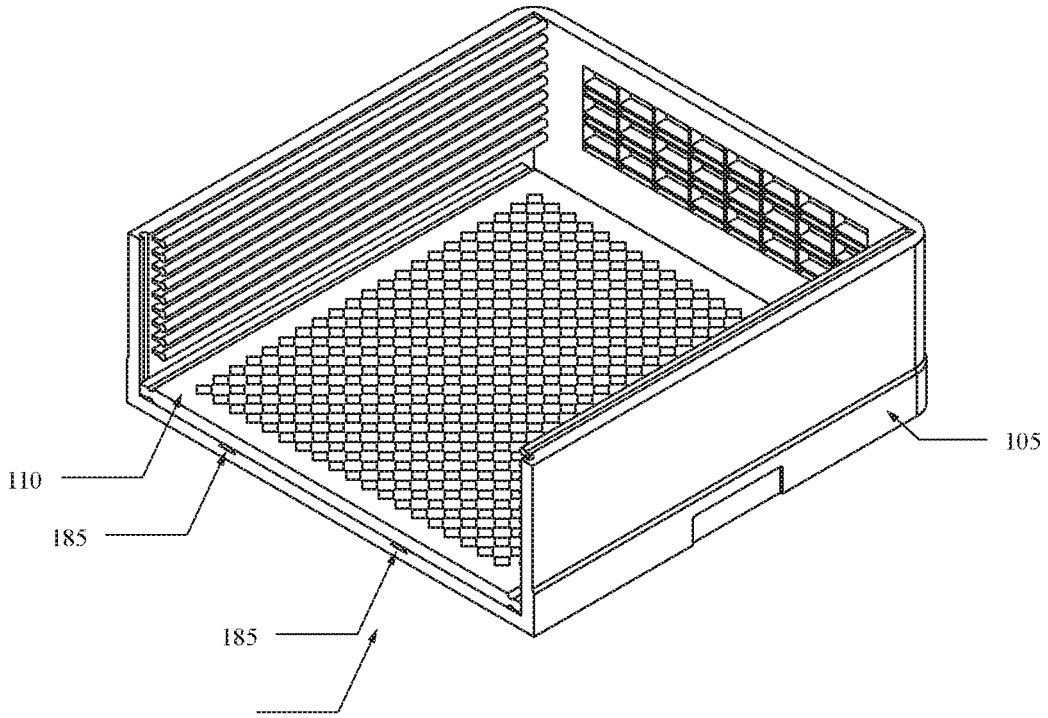
FIG. 13 shows an exemplary perspective view of one embodiment of the adjustable dishwasher rack.
Figure 14:
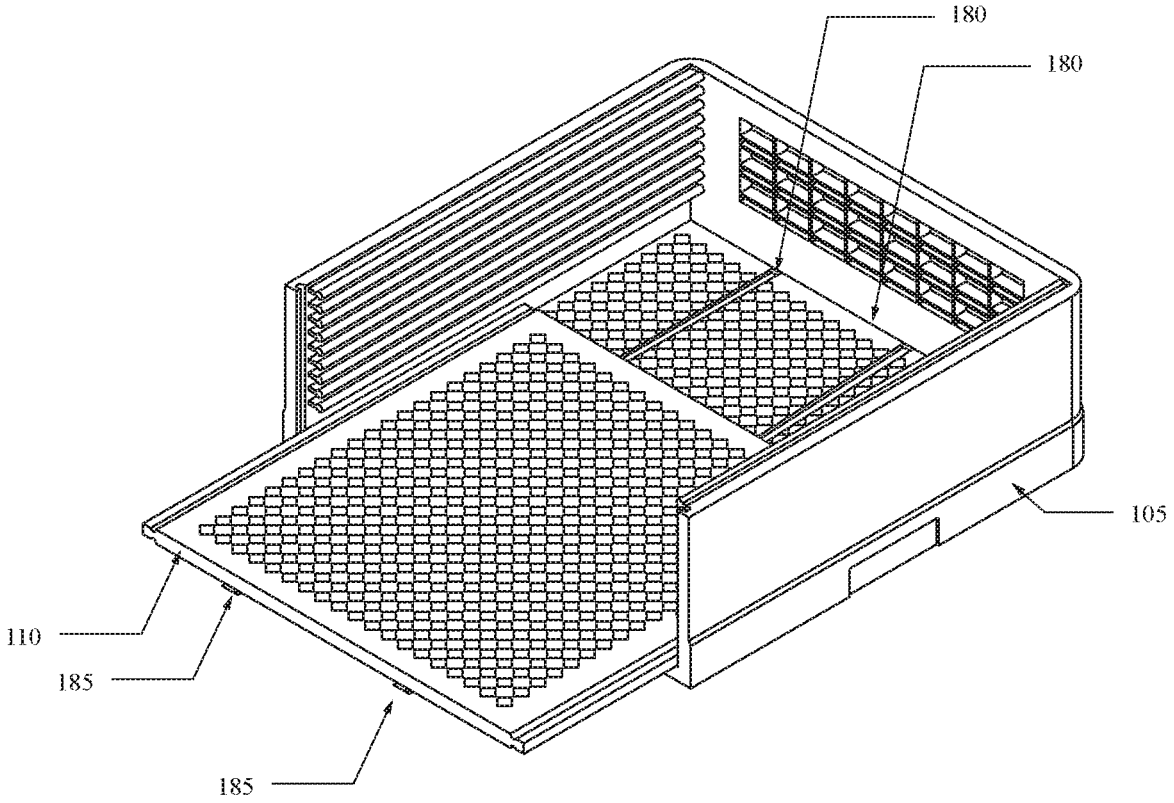
FIG. 14 shows an exemplary perspective view of one embodiment of the adjustable dishwasher rack.

As shown in FIGS. 13-14 in some washing environments it can be necessary to cover the base plate member with a second base plate (not shown) within the adjustable dishwashing rack. In this embodiment, a fifth connection assembly extends a length of the base member and is joined to the base member. As the fifth connection 180 assembly extends along the base plate the fifth connection assembly is oriented parallel with the base plate. The second base plate includes a top surface, a bottom surface, and a third perimeter edge. The bottom surface of the second base plate comprises a sixth connection 185 assembly extending a length of the second base plate and is joined to the second base plate. The sixth connection assembly is adapted and configured to match the fifth connection assembly. The user can, if desired, insert or remove the second base plate from within the internal volume of the adjustable dishwashing rack. The second base plate serving as a means for a replacement for the original base plate. For example, the user may require a different size of the first openings protruding through the base plate for smaller articles being washed. In some embodiments, the second base plate further comprises a third plurality of protrusions extending perpendicular from the second base plate Alike the first plurality of protrusions and the second plurality of protrusions, the third plurality of protrusions assist in limiting movement of the articles within the adjustable dishwashing rack.

FIGS. 12A-F illustrate different exemplary embodiments for the first connection assembly. In some embodiments the first connection assembly, the second connection assembly, the third connection assembly, the fourth connection assembly, the fifth connection assembly, and the sixth connection assembly comprise at least one a member of a connection set consisting of: a slot, a rail, a joint, a magnet, an elastic member, a snap-fit, a clamp, a clip and a fastener. In other embodiments, the rail and the joint of the connection set are chosen from, by way of non-limiting example, a rail set consisting of: a dovetail rail, a tongue and groove joint, a linear guide rail, a dado joint, and a dovetail joint.

In some embodiments, the adjustable dishwashing rack is made of at least one material of a material set consisting of: a ceramic material, a metal material, a wood material a plastic material, a fiber glass material, an acrylic material, a composite material, a thermoset plastic, a thermoplastic, a glass material, and a nylon material. Exemplary materials of the adjustable dishwashing rack material set include, by way of non-limiting example, the following materials: a High-density polyethylene (HDPE) material, a low-density polyethylene (LDPE), a Polypropylene (PP), a rubber material, a Polyvinyl chloride (PVC) material, a urethane material, a polyurethane material and any other material known to one skilled in the art of commercial sanitation and dishwashing.

In some embodiments, the adjustable dishwashing rack further comprises at least one member of an identification set consisting of: an alphanumeric identification, a human user's name, a symbolic shape, a company brand, a numeric identification number, a QR code, a barcode, and an RFID tag. For example, the adjustable dishwashing rack may display a symbolic shape representing at least one article to be washed within the adjustable dishwashing rack.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

Unless otherwise defined, all technical terms used herein have the same meaning as commonly understood by one of ordinary skill in the art to which this disclosure belongs.

As used herein, the singular forms "a," "an," and "the" include plural references unless the context clearly dictates otherwise. Any reference to "or" herein is intended to encompass "and/or" unless otherwise stated.

As used herein, the term "about" refers to an amount that is near the stated amount by about 0%, 5%, or 10%, including increments therein.

Unless otherwise defined, all technical terms used herein have the same meaning as commonly understood by one of ordinary skill in the art to which this disclosure belongs.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An adjustable dishwashing rack for washing an article, the adjustable dishwashing rack comprising:

a base member having a base plate and at least two vertical walls extending away from the base plate to form an internal volume;

at least one lid having a top surface, a bottom surface, and a rounded first perimeter edge, wherein the first perimeter edge is adjoined to the at least two vertical walls of the base member;

at least one vertical removable end wall having an internal surface, an external surface, and a rounded second perimeter edge, wherein the second perimeter edge is adjoined to the at least two vertical walls of the base member;

wherein a first mode of operation a user adjusts the at least one lid relative to the base plate to limit movement of the article within the adjustable dishing dishwashing rack.

2. The adjustable dishwashing rack of claim 1, further comprising:

wherein a second mode of operation the user removes the at least one removable end wall from the base member, adjusts the at least one lid to limit movement of the article within the adjustable dishwashing rack.

3. The adjustable dishwashing rack of claim 1, further comprising:

a first connection assembly joined to the at least two vertical walls, wherein the first connection assembly is oriented parallel with the base plate; and, a third connection assembly joined to the first perimeter edge of the at least one lid and configured to join to the first connection assembly, wherein the third connection assembly serves as means to secure the at least one lid to the base member and partition the internal volume.

4. The adjustable dishwashing rack of claim 3, further comprising:

a second connection assembly extending a height of the at least two vertical walls, wherein the second connection assembly is oriented perpendicular to the base plate; and, a fourth connection assembly joined to the second perimeter edge and at least one vertical removable end wall and configured to join to the second connection assembly, wherein the fourth connection assembly serves as means to secure at least one vertical removable end wall to the base member.

5. The adjustable dishwashing rack of claim 1, wherein the base member further comprises at least one handle protruding into the base member and configured to grip a hand of a human.

6. The adjustable dishwashing rack of claim 1, wherein the base member further comprises at least one perforated opening extending through the base member.

7. The adjustable dishwashing rack of claim 1, wherein the at least one lid further comprises at least one perforated opening extending through the at least one lid.

8. The adjustable dishwashing rack of claim 2, wherein the at least one vertical removable end wall further comprises at least one perforated opening extending through the at least one removable end wall.

9. The adjustable dishwashing rack of claim 1, wherein the base member is further configured to match an internal shape of a commercially available dishwasher.

10. The adjustable dishwashing rack of claim 4, wherein the first connection assembly, the second connection assembly, the third connection assembly, and the fourth connection assembly comprises at least one member of a connection set consisting of: a slot, a rail, a joint, a magnet, an elastic member, a snap-fit, a clamp, a clip, and a fastener.

11. The adjustable dishwashing rack of claim 1, wherein the base plate further comprises a plurality of protrusions extending outward from the base plate and into the internal volume.

12. The adjustable dishwashing rack of claim 11, wherein the plurality of protrusions are conical and configured to substantially match a size and shape of at least one cup.

13. The adjustable dishwashing rack of claim 12, wherein the base member further comprises an external texture to grip a hand of a human.

14. The adjustable dishwashing rack of claim 13, wherein the external texture further comprises at least one member of a texture set consisting of: indentations, extrusions, knurling, a rough surface, and bumps.

15. The adjustable dishwashing rack of claim 1, wherein the adjustable dishwashing rack further comprises at least one member of an identification set consisting of: an alphanumeric identification, a human user's name, a symbolic shape, a company brand, a numeric identification number, Quick Response (QR) code, a barcode, and Radio-Frequency Identification (RFID) tag.

16. The adjustable dishwashing rack of claim 1, wherein the at least one lid further comprises a second-plurality of protrusions extending perpendicular from the at least one lid; and wherein the second plurality of protrusions limit movement of the article.

* * * * *